US012352135B2

(12) United States Patent
Vodianov

(10) Patent No.: US 12,352,135 B2
(45) Date of Patent: Jul. 8, 2025

(54) TURBOGENERATOR FOR DOWNHOLE EQUIPMENT SUPPLY

(71) Applicant: ALTDS LLC, Sunny Isles Beach, FL (US)

(72) Inventor: Artem Vodianov, Sunny Isles Beach, FL (US)

( * ) Notice: Subject to any disclaimer, the term of this patent is extended or adjusted under 35 U.S.C. 154(b) by 0 days.

(21) Appl. No.: 18/202,185

(22) Filed: May 25, 2023

(65) Prior Publication Data

US 2024/0392656 A1 Nov. 28, 2024

(51) Int. Cl.
*E21B 41/00* (2006.01)

(52) U.S. Cl.
CPC ..... *E21B 41/0085* (2013.01)

(58) Field of Classification Search
CPC ..... E21B 41/0085
See application file for complete search history.

(56) References Cited

U.S. PATENT DOCUMENTS

2019/0089220 A1* 3/2019 McMullen ..... F16C 32/0451

* cited by examiner

*Primary Examiner* — Viet P Nguyen
(74) *Attorney, Agent, or Firm* — LAW OFFICES OF VERA CHERNOBYLSKY; Vera Chernobylsky

(57) ABSTRACT

The invention relates to the downhole equipment power supplies. The technical result is increasing reliability and operational life of the device, as well as design and its operation simplification. The turbogenerator containing the internal stator with winding and external rotor with a housing mounted on sliding bearings and turbine blades is proposed. At the same time, the internal and external surfaces of the journal bearings are made of hard long-wearing material with high thermal conductivity. Besides, the turbogenerator contains a sealing element preventing through flow of the flushing fluid through the gap between the stator and the rotor. In particular, the sealing element can be made in the form of contact seal installed below the upper bearing. At the same time, one row of windows is made on the rotor housing, the entrance to which is located between the upper bearing and the contact seal on the inside of the rotor housing and the exit from which is located below the impeller on the outside of the rotor. The sealing element can also be made in the form of cover installed on the upper end of the rotor.

1 Claim, 2 Drawing Sheets

TURBOGENERATOR FOR DOWNHOLE EQUIPMENT SUPPLY

FIELD OF THE INVENTION

The invention relates to research in the process of drilling wells and can be used to supply electric power to downhole devices during drilling.

BACKGROUND

The turbogenerator for downhole equipment supply is known, containing the external rotor with casing and turbine blades, mounted on sliding bearings, the internal stator with winding made on the axis and placed in the sealed housing, on the outer surface of which screw grooves are made. Longitudinal grooves are made on the inner surface of the rotor passing between the magnets.

The disadvantage of this turbo generator is its low reliability, due to the fact that ferromagnetic inclusions which are always present in the drilling mud flowing in the gap between the stator and the rotor, stick to the surface of the rotor magnets in places with the greatest field strength and cannot get out of this gap, held by magnetic forces. This leads to gradual plugging of the gap with magnetic inclusions, and, as a result, to occurrence of additional friction, decrease in rotor speed movement until it stops completely. The rate of accumulation of layer of ferromagnetic inclusions on the rotor magnets is proportional to their content in the drilling mud and the size of the drilling mud flow in the stator-rotor gap. The amount of through flow of drilling mud in the gap between the stator and the rotor in this turbo generator is significant, in this gap, the same flow passes through, which also flows through the bearings and is necessary for their cooling.

The turbogenerator for downhole equipment supply is known, containing the external rotor with magnets, the internal stator with winding made on the axis. The external rotor is mounted on sliding bearings. Two rows of windows can be made on the rotor for the abrasive particles to exit through them outside.

The disadvantage of this turbo generator is its low reliability due to the same reason. In this turbogenerator design, a drilling fluid flow is also used to cool the sliding bearings. This is since the internal surfaces of the journal bearings are made of the elastic material, for example rubber, that is, of material with very low thermal conductivity, which excludes another way of removing the heat released in the bearings—by thermal conductivity through the bearing body. The application of two rows of windows on the rotor housing slightly reduces the amount of drilling mud flowing through the stator-rotor gap but does not completely exclude it. This through drilling mud flow passes through the stator-rotor gap, leading to gradual gap plugging by magnetic inclusions, and, as a result, to occurrence of additional friction, decrease in rotor speed movement until it stops completely.

DESCRIPTION OF THE INVENTION

The task of creating the invention is to increase reliability of the turbo generator operation.

The specified problem has been solved due to the fact that a turbogenerator for powering downhole equipment containing an internal stator with a winding made on an axis and placed in a sealed housing, screw grooves are located on an outer surface of the sealed housing, the external rotor with casing and turbine blades mounted on upper and lower sliding bearings, internal and external surfaces of sliding bearings are made of hard long-wearing material with high thermal conductivity, the turbogenerator contains a sealing element preventing the through flow of the flushing fluid through the gap between the stator and the rotor and made or in the form of contact seal installed below the upper bearing, while row of windows is made on the rotor housing, the entrance to which is located between the upper bearing and the contact seal on the inside of the rotor housing, and the exit of which is located below the impeller on the outside of the rotor, or in the form of cover installed on the upper end of the rotor. The external upper and external lower sliding bearings are located on the rotor, and the internal upper and internal lower sliding bearings are on the stator.

The essence of the invention is explained in the drawing, where FIG. 1 shows a general view of turbogenerator with two-support mount and FIG. 2 shows a general view of turbogenerator with a cantilever mounting.

The turbogenerator depending on the layout scheme of the downhole device may have different mounting methods—cantilever or two-support. The cantilever mounting of the turbogenerator is used when all the electric energy consumers are located below the turbogenerator (measure while drilling with electromagnetic communication channel and lower location of the insulator, measure while drilling with hydraulic communication channel and lower location of the pulsator). The two-support mounting of the turbogenerator is used when a portion of the electric energy consumers is located below the turbogenerator, while another portion is positioned above the turbogenerator (measure while drilling with electromagnetic communication channel and upper location of the insulator, measure while drilling with hydraulic communication channel and upper location of the pulsator).

The turbogenerator for the downhole equipment supply is installed in the drilling string (not shown) and is mounted in it using the lower mounting unit 1, and for the variant with a two-support mounting using the upper mounting unit 2 (the design of turbogenerator mounting units is not shown, since it can be any depending on the layout of the telesystem). The turbogenerator contains the internal stator 3 and the external rotor 4 with a turbine impeller 5 installed on it.

Magnets 6, the outer bush of the upper bearing 7, the outer bush of the lower bearing 8 and the thrust bearing heel toe 9 (rotating part of the thrust bearing) are mounted in the housing of the external rotor 4.

The inner bush of the upper bearing 10, the inner bush of the lower bearing 11 and the thrust collar 12 (non-rotating part of the thrust bearing) are mounted on the internal stator 3. The thrust bearing location along the height of the turbogenerator can be any, as shown in FIGS. 1 and 2.

The guide device of turbine 13 in a two-support turbo generator can be mounted in any known way in the upper part of the turbogenerator with some gap from the rotor and can serve as a limiter of the rotor stroke upwards. In the cantilever turbogenerator the guide device (not shown) is installed, if necessary, in the drilling string above the turbogenerator.

In the turbo generator with a two-support mounting the sealing element is a contact seal (end seal or cuff). FIG. 1 shows a variant with end seal consisting of the non-rotating ring 14 mounted to the internal stator 3, the rotating ring 15 mounted in the housing of the external rotor 4, sealed with rubber ring 16 and pressed against the non-rotating ring 14 by spring 17. There is a row of windows 18 between the contact seal and the upper bearing connecting the internal rotor cavity with the external cavity.

In the turbogenerator with cantilever mounting the sealing element is a cover 19 installed in any known way (for example, using thread 20 and an O-ring 21) on the upper end of the external rotor 4. Cover 19 can simultaneously be a lock on the replaceable impeller of turbine 5 (shown in FIG. 2) or be made in the form of single unit with a replaceable turbine impeller 5. In cover 19 there is a hole 22, closed by plug 23 in the working position, installed, for example, using thread 24 and scaled with rubber ring 25.

The hole 26 can be made in the plug, allowing the internal volume to be connected to the external one when plug 23 is partially turned out. Plug 23 can serve as the lock key of the external rotor 4. A possible variant of the lock mechanism is shown in FIG. 2. The lock can be the lamellae of collet 27, which in their free state are bent (by elastic forces) to the central axis of the collet and allow free exit of the collet from the stepped hole in the upper part of the internal stator 3. When plug 23 is screwed in, the lamellae of the collet 27 are forcibly bent outward, preventing the collet from free exiting the stepped hole in the upper part of the internal stator 3.

The turbogenerator with a two-support mounting (FIG. 1) works as follows. Drilling mud passing through the blades of the guide device 13 (if it is installed), falls on the blades of the impeller 5, driving it and the external rotor 4 with it into rotation. Some part of the drilling mud passes through the gap between the inner bush of the upper bearing 10 and the outer bush of the upper bearing 7 into the inner cavity of the external rotor 4 and exits it through windows 18. The drilling mud flow in the gap between the internal stator 3 and the external rotor 4 in the area of the magnets is excluded, since it is prevented by sealing element—contact seal (in FIG. 1—end seal). The contact seal (end seal or cuff) works in benign conditions, since the pressure drop 25 on it is minimal, which is explained by very small amount of hydraulic resistance of windows 18 having large internal cross-section, compared with the hydraulic resistance of the gap in the upper bearing (parts 7 and 10), and the pressure drop in the drilling mud flow on the rotor length from the windows to the lower section of the rotor is also insignificant. To dismantle the external rotor 4 it is enough to remove the guide device 13.

The turbogenerator with cantilever mounting (FIG. 2) works as follows. Drilling mud passing through the blades of the guide device (if it is installed, not shown in FIG. 2), falls on the blades of the impeller 5, driving it and the external rotor 4 with it into rotation. In this version of the turbogenerator the flow of drilling mud 35 in the gap between the internal stator 3 and the external rotor 4 in the area of the magnets is prevented by sealing element—the cover 19. To dismantle the external rotor 4 it is necessary to unscrew the plug 23 to the value at which the rotor attachment lock (for example, the collet 27) is released, and the inner cavity of the external rotor 4 receives communication with the external environment through the hole 26 in the plug 23. To change the impeller and/or to clean the inner surface of the external rotor 4 when during maintenance better, it is necessary to remove the cover 19 from the external rotor 4. It is possible to design cover 19 as a single part with the impeller 5.

Since the surfaces of the sliding bearings (both radial and thrust bearings) are made of hard long-wearing material with high thermal conductivity (for example, from tungsten carbide-based hard alloy using cobalt or nickel ligament), heat removal from them is successfully provided by heat flow through the bearing body, the need for a through flow of drilling mud through bearings for their cooling is disappeared. Heat removal from the stator is sufficiently provided due to thermal conductivity through the metal walls of the external rotor 4 (including magnets), the flow of drilling mud through the stator-rotor gap is not required to cool the stator.

Since there is no through flow of drilling mud in the gap past the magnets, then magnetic inclusions on the magnets do not accumulate. Accidentally trapped solid inclusions are removed from the inner cavity along the lubricating screw grooves available both on the surface of the inner bushes of the bearings 10 and 11, and on the sealed housing of the internal stator 3. The ease of partial disassembly of the turbogenerator (dismantling of the external rotor 4) makes it possible to clean the inner surface of the external rotor 4 and the outer surface of the internal stator 3 from the remnants of drilling mud regularly, for example, after each run, and fill the inner cavity with grease to prevent solid inclusions from entering at the moment the drilling mud circulation is enabled.

The application of the invention allowed:

1. Increase the reliability and service life of the turbo generator.
2. Simplify the turbogenerator design.
3. Facilitate the turbogenerator operation.

BRIEF DESCRIPTION OF THE DRAWINGS

The essence of the invention is explained in the drawing.

Figure 1:
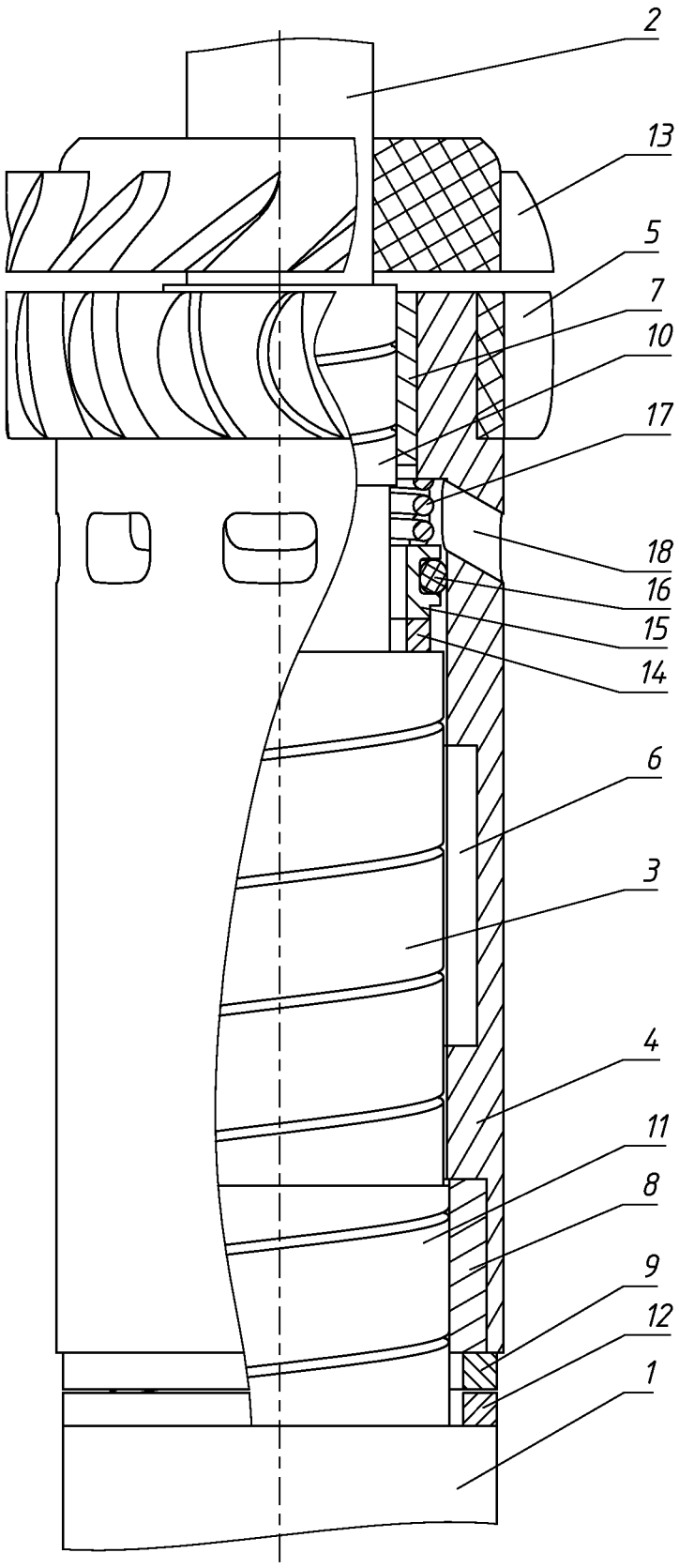
FIG. 1. shows a general view of turbogenerator with two-support mount.
Figure 2:
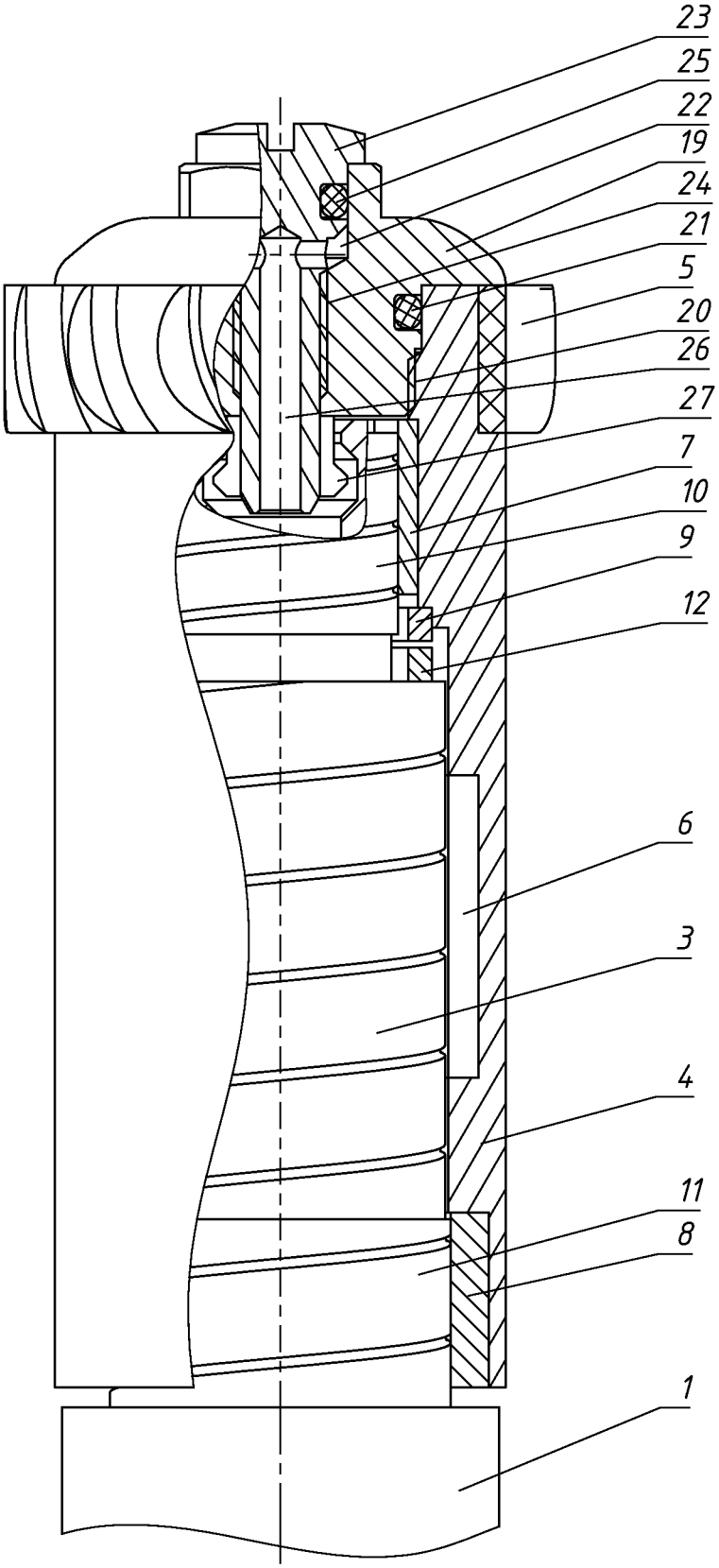
FIG. 2. shows a general view of turbogenerator with a cantilever mounting.

The invention claimed is:

1. A turbogenerator for downhole equipment supply comprising:

an internal stator with windings positioned on an axis and placed in a sealed housing, wherein screw grooves are located on an outer surface of the sealed housing;

an external rotor with a rotor housing and turbine blades mounted on upper and lower sliding bearings, wherein the internal and external surfaces of the sliding bearings are made of hard long-wearing material with high thermal conductivity;

a sealing element preventing through flow of flushing fluid through a gap between the stator and the rotor and made in the form of a contact seal installed below the upper sliding bearing;

one row of windows located on the rotor housing, wherein the entrance of which is located between the upper sliding bearing and the contact seal on the inside of the rotor housing, and the exit of which is located below the turbine blades on the outside of the rotor housing;

wherein the sealing element preventing the flushing fluid from passing through the gap between the stator and the rotor is further made in the form of a cover installed on an upper end of the rotor housing.

* * * * *